US007720562B2

(12) United States Patent
Torikoshi

(10) Patent No.: US 7,720,562 B2
(45) Date of Patent: May 18, 2010

(54) POLISHING METHOD AND POLISHING APPARATUS

(75) Inventor: Tsuneo Torikoshi, Tokyo (JP)

(73) Assignee: Ebara Corporation, Tokyo (JP)

( * ) Notice: Subject to any disclaimer, the term of this patent is extended or adjusted under 35 U.S.C. 154(b) by 221 days.

(21) Appl. No.: 11/979,605

(22) Filed: Nov. 6, 2007

(65) Prior Publication Data

US 2008/0254714 A1 Oct. 16, 2008

(30) Foreign Application Priority Data

Nov. 8, 2006 (JP) ..... 2006-302773

(51) Int. Cl.
*G06F 19/00* (2006.01)
*B24B 37/04* (2006.01)

(52) U.S. Cl. ..... 700/164; 700/121; 438/692

(58) Field of Classification Search ..... 700/121, 700/164; 451/5, 56, 443; 438/692, 694
See application file for complete search history.

(56) References Cited

U.S. PATENT DOCUMENTS 6,113,462 A * 9/2000 Yang ..... 451/5
6,594,542 B1 * 7/2003 Williams ..... 700/164
6,914,000 B2 * 7/2005 Kamada ..... 438/692
7,004,814 B2 * 2/2006 Chen et al. ..... 451/5
2003/0017692 A1 * 1/2003 Noguchi et al. ..... 438/622
2005/0197046 A1 * 9/2005 Aoyagi et al. ..... 451/5
2007/0049166 A1 3/2007 Yamaguchi et al.

OTHER PUBLICATIONS

Preliminary Amendment filed in U.S. Appl. No. 11/508,140 on Jan. 17, 2007.

* cited by examiner

*Primary Examiner*—Ramesh B Patel
*Assistant Examiner*—Douglas S Lee
(74) *Attorney, Agent, or Firm*—Wenderoth, Lind & Ponack, L.L.P.

(57) ABSTRACT

A polishing method enables to initiation a second polishing step of a workpiece with an optimal thickness of an uppermost-layer film to be polished. The polishing method comprises: measuring a thickness of an uppermost-layer film, and then carrying out a first polishing step to polish the uppermost-layer film partway and a second polishing step to polish the remaining uppermost-layer film and a next-layer film; determining the polishing rates of the uppermost-layer film in the first and second polishing steps; and measuring a thickness of an uppermost-layer film of a predetermined nth workpiece and setting a processing time for the first polishing step of the nth workpiece or a next predetermined nth workpiece.

16 Claims, 6 Drawing Sheets

POLISHING METHOD AND POLISHING APPARATUS

BACKGROUND OF THE INVENTION

1. Field of the Invention

The present invention relates to a polishing method and a polishing apparatus which are useful for polishing and flattening a surface (surface to be polished) of a substrate, such as a semiconductor wafer.

2. Description of the Related Art

In the formation of integrated circuits on a surface of a substrate, such as a semiconductor wafer, it is a general practice to deposit an insulating film, a conductive film or a semiconductive film, etc. on the surface of the substrate, and form integrated circuit interconnects in the deposited film. For the formation of such interconnects, lithography of an integrated circuit pattern with light or electron beams is carried out. In order to form fine interconnects, it is necessary to make the width of a lithography pattern as narrow as possible, which requires a shallower focus depth. This necessitates flattening of a surface of a semiconductor wafer on which lithography is to be carried out. As a method for the flattening, polishing by a chemical mechanical polishing (CMP) apparatus is generally practiced. A multi-stage CMP process is known which comprises polishing a laminate of films formed in a surface of a substrate, such as a semiconductor wafer, in a plurality of process steps.

For example, a substrate W to be polished, as shown in FIG. 6A, is prepared by forming trenches 302 in an insulating layer 300 and forming a barrier film 304 of, e.g., SiN on a surface of the insulating layer 300, and then depositing an oxide film 306 on a surface of the barrier film 304 while filling the oxide film 306 into the trenches 302. In an exemplary multi-step CMP process, a first polishing step of the surface of the substrate W is carried out to polish the oxide film 306 partway, and then a second polishing step is carried out to polish the remaining oxide film 306 and a predetermined amount (to a target value) of the barrier film 304, as shown in FIG. 6A. In this case, the first polishing step may be carried out by using a polishing liquid (slurry) which has a high polishing rate for the oxide film 306, though low in its surface irregularities-eliminating property for the oxide film 306, and then the second polishing step may be carried out by using a polishing liquid which has a high surface irregularities-eliminating property for the oxide film 306, though low in the polishing rate for the oxide film 306, so as to increase the polishing amount of the oxide film 306 in the first polishing step and to thereby shorten the overall polishing time.

As shown in FIG. 6A, when the oxide film 306 is deposited on the insulating layer 300 in which the trenches 302 are formed, depressions are formed in those portions of the surface of the oxide film 306 which correspond to the trenches 302 provided in the insulating layer 300. In order to increase the throughput, it is desirable to polish the oxide film (uppermost-layer film) 306 as much as possible in the first polishing step using a polishing liquid having a high polishing rate for the oxide film 306 and to minimize the polishing of the oxide film 306 in the second polishing step using a polishing liquid having a low polishing rate for the oxide film 306. However, the first polishing step using a polishing liquid having a low surface irregularities-eliminating property cannot flatten the depressions in the surface of the oxide film 306, and the depressions need to be eliminated by the second polishing step. It is therefore necessary to terminate the first polishing step when the oxide film (uppermost-layer film) 306 is partly left.

On the other hand, the overall polishing time becomes longer if the second polishing step is initiated when the oxide film (uppermost-layer film) 306 remains in excess. Further, since a polishing liquid used in the second polishing step generally has low polishing ability for the lower-layer barrier film 304, the second polishing step needs to be carried out over a considerably long time. When the second polishing step is thus carried out over a long time, excessive polishing may occur in the surface of the oxide film 306 in the trenches 302, forming a depression having a depth "d", as shown in FIG. 6B, which may cause dishing or erosion. Thus, the second polishing step should desirably be initiated with an optimal thickness of the oxide film 306 to be polished.

However, a thickness of a film to be polished, like the oxide film 306, forming an uppermost surface layer of a substrate, such as a semiconductor wafer, generally varies among substrates. In addition, the polishing rate of an uppermost-layer film can decrease, e.g., due to deterioration of a consumable member of a polishing apparatus. It has therefore been generally difficult to make a thickness of an uppermost-layer film constant at the start of the second polishing step.

SUMMARY OF THE INVENTION

The present invention has been made in view of the above situation in the related art. It is therefore an object of the invention to provide a polishing method and a polishing apparatus which make it possible to initiate a second polishing step of a workpiece with an optimal thickness of an uppermost-layer film to be polished, without being influenced by possible variation in the initial thickness of the uppermost-layer film among workpieces.

In order to achieve the object, the present invention provides a polishing method for carrying out a plurality of steps of polishing on a workpiece having a plurality of films to be polished, comprising: measuring a thickness of a film, forming the uppermost layer of a workpiece, before polishing, and then carrying out a first polishing step to polish the uppermost-layer film partway and a subsequent second polishing step to polish the remaining uppermost-layer film and a next-layer film, the first and second polishing steps being carried out under preset polishing conditions; determining the polishing rates of the uppermost-layer film in the first and second polishing steps based on the measured thickness of the uppermost-layer film and on the processing time taken to polish the uppermost-layer film in the first and second polishing steps; and measuring a thickness of a film, forming the uppermost layer of a predetermined nth workpiece, before polishing and, based on the measured thickness and on said polishing rates of the uppermost-layer film, setting a processing time for the first polishing step of the nth workpiece or a next predetermined nth workpiece.

By thus carrying out a multi-step polishing process for a workpiece after measuring a thickness of an uppermost-layer film of the workpiece, determining the polishing rates of the uppermost-layer film in the first and second polishing steps based on the measured thickness of the uppermost-layer film and on the processing time taken to polish the uppermost-layer film in the first and second polishing steps, and determining a processing time for the first polishing step of a predetermined nth workpiece based on the pre-determined polishing rates and on the thickness of an uppermost-layer film of the nth workpiece before polishing, it becomes possible to equalize a thickness of the uppermost-layer film at the start of the second polishing step for every workpiece.

The predetermined nth workpiece may be the next unpolished workpiece.

By applying the feedback of the polishing time to the next unpolished workpiece, a polishing rate can be set which responds to a change in polishing performance, e.g., due to deterioration of a consumable member of the polishing apparatus.

Preferably, the processing time for the first polishing step of the nth workpiece is set so that the thickness of the uppermost-layer film becomes a predetermined thickness at the start of the second polishing step of the nth workpiece.

In a preferred aspect of the present invention, the first polishing step is carried out by moving a polishing table, having a polishing face, and a top ring, holding the workpiece and pressing it against the polishing face, relative to each other, and a change of polishing object from the uppermost-layer film to the next-layer film is detected by detecting the torque of a drive section for driving the polishing table or the top ring.

By detecting a change of polishing object from the uppermost-layer film to the next-layer film by detecting the torque of a drive section for driving the polishing table or the top ring, it becomes unnecessary to transport, e.g., an optical device for measurement of a film thickness between the first polishing step and the second polishing step, which requires cleaning and drying of the workpiece, thereby leading to an increased throughput.

The present invention also provides a polishing apparatus comprising: a polishing section for carrying out a first polishing step of a film forming the uppermost layer of a workpiece and a second polishing step of the remaining uppermost-layer film and a next-layer film; a measurement section for measuring a thickness of the uppermost-layer film of the workpiece before polishing; and a control section for determining the polishing rates of the uppermost-layer film in the first and second polishing steps based on the thickness of the uppermost-layer film before polishing, measured with the measurement section, and on the processing time taken to polish the uppermost-layer film in the first and second polishing steps, and setting a processing time for the first polishing step of a predetermined nth workpiece based on said polishing rates of the uppermost-layer film and on the thickness of a film forming the uppermost layer of the nth workpiece before polishing.

Preferably, the processing time for the first polishing step of the nth workpiece is set so that the thickness of the uppermost-layer film becomes a predetermined thickness at the start of the second step of polishing of the nth workpiece.

In a preferred aspect of the present invention, the polishing section includes a polishing table having a polishing face, and a top ring for holding the workpiece and pressing the workpiece against the polishing face, and the change of polishing object from the uppermost-layer film to the next-layer film is detected by detecting the torque of a drive section for driving the polishing table or the top ring.

The polishing section may have a first polishing table for carrying out the first polishing step, and a second polishing table for carrying out the second polishing step.

Alternatively, the polishing section may have a polishing table for successively carrying out the first and second polishing steps.

The present invention also provides a program for causing a computer to control a polishing apparatus, for carrying out a plurality of steps of polishing on a workpiece having a plurality of films to be polished, to perform operations of: determining the polishing rates of a film, forming the uppermost layer of a workpiece, in a first polishing step and a second polishing step based on the thickness of the uppermost-layer film before polishing and on the polishing time taken to polish the uppermost-layer film in the first and second polishing steps; and based on said polishing rates and on the thickness of a film, forming the uppermost layer of a predetermined nth workpiece, before polishing, setting a processing time for the first polishing step of the nth workpiece.

The predetermined nth workpiece may be the next unpolished workpiece.

Preferably, the processing time for the first polishing step of the nth workpiece is set so that the thickness of the uppermost-layer film becomes a predetermined thickness at the start of the second polishing step of the nth workpiece.

According to the polishing method and the polishing apparatus of the present invention, in carrying out a multi-step polishing process on workpieces, such as substrates, each having multi-layer films to be polished, a thickness of the uppermost-layer film at the start of the second polishing step can be equalized for all the workpieces even when there is variation in the initial thickness of the uppermost-layer film among the workpieces. Furthermore, the present invention makes it possible to formulate a polishing recipe taking into account wear of a polishing member, thereby preventing dishing or erosion in a surface of a film after polishing.

DETAILED DESCRIPTION OF THE PREFERRED EMBODIMENTS

Preferred embodiments of the present invention will now be described with reference to the drawings. The following description illustrates the case of using a substrate, such as a semiconductor wafer, as a workpiece, and polishing and flattening a surface (surface to be polished) of a substrate.

Figure 1:
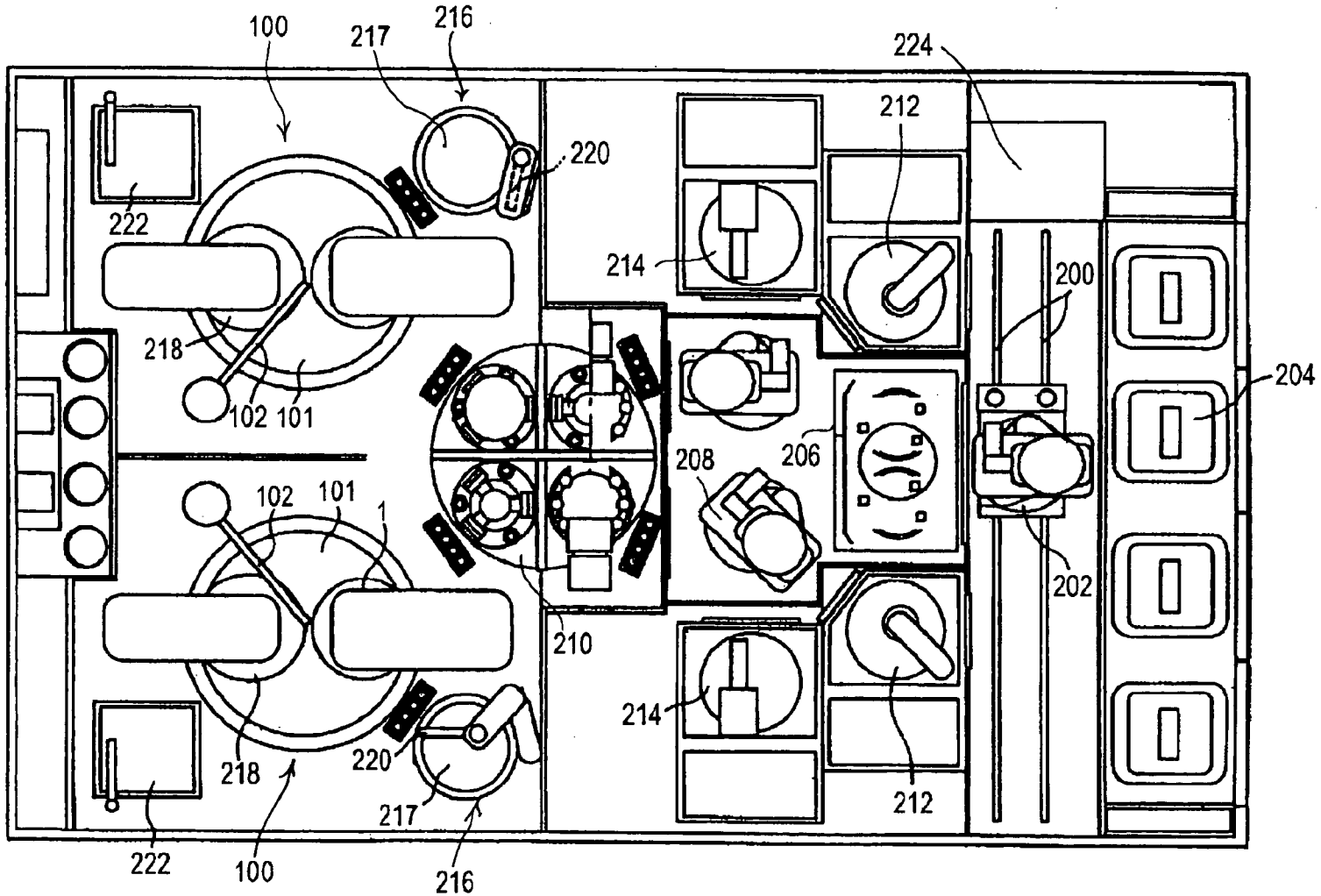
FIG. 1 is a plan view of the overall layout of a polishing apparatus according to an embodiment of the present invention.

FIG. 1 shows a plan view of the overall layout of a polishing apparatus according to an embodiment of the present invention. As shown in FIG. 1, in the polishing apparatus, unpolished substrates (workpieces), such as semiconductor wafers, stocked in a cassette 204 are taken one by one by a transport robot 202, which moves on traveling rails 200, out of the cassette 204, and placed on a substrate stage 206. The unpolished substrate on the substrate stage 206 is transferred by a transport robot 208 onto a rotary transporter 210, while a polished substrate is transferred by the transport robot 208 from the rotary transporter 210 onto the substrate stage 206. The polished substrate on the substrate stage 206 is returned by the transport robot 202 into the cassette 204. The unpolished substrate on the rotary transporter 210 is held by a top ring 1, which is described below, and moved to a position on a polishing table 100 to carry out polishing of the substrate. The polishing apparatus is thus systematized so that a plurality of substrates can be polished successively.

The polishing apparatus includes cleaning machines 212, 214 for cleaning and drying a substrate after polishing, a polishing table 216 for carrying out a second polishing step of a substrate surface, dressers 218, 220 for carrying out dressing of the polishing tables 100, 216, and a water tub 222 for cleaning the dresser 218. The polishing apparatus is designed to be capable of carrying out two or more steps of polishing with one polishing table 100 by switching a plurality of polishing liquids and a plurality of polishing conditions (polishing recipes).

Figure 2:
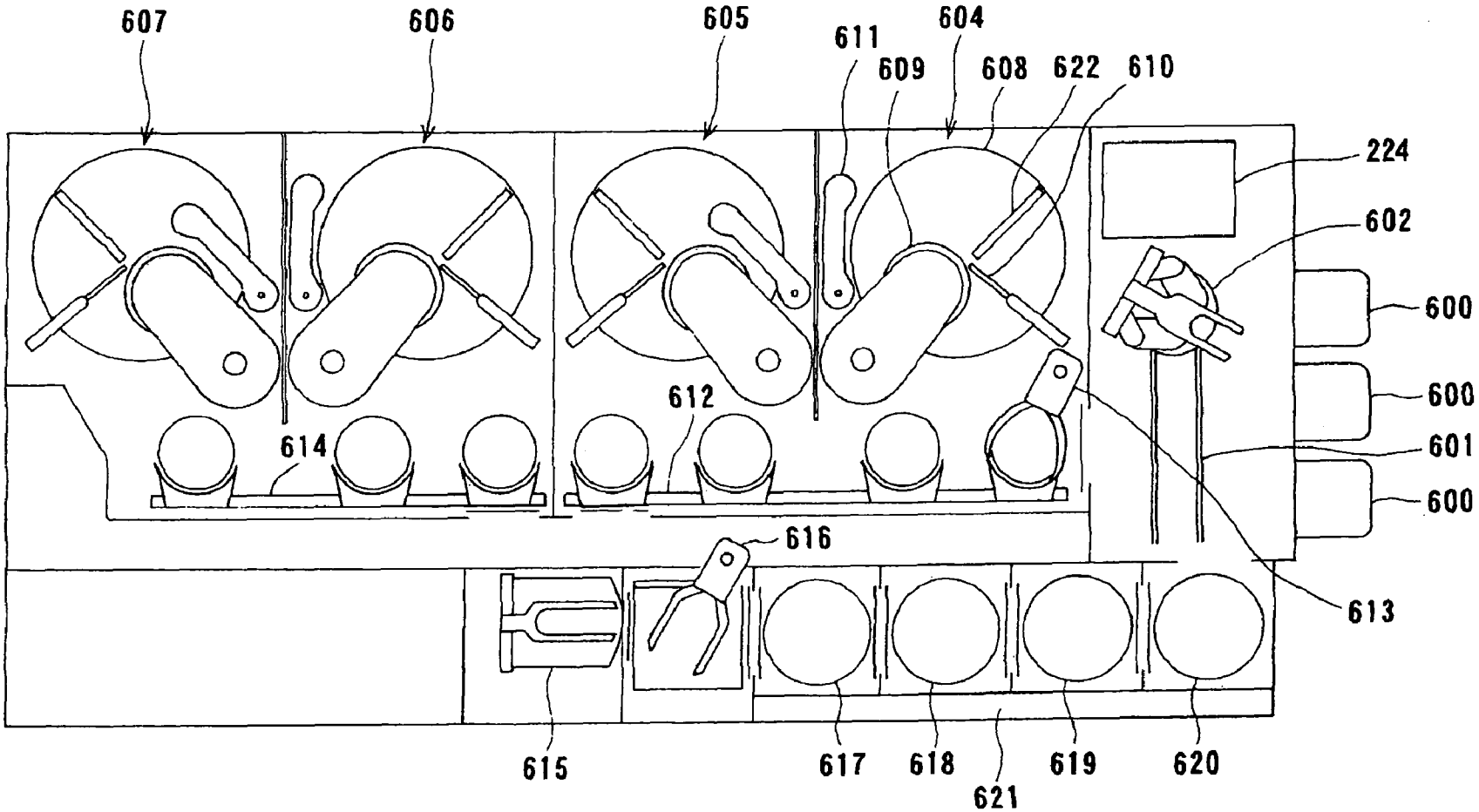
FIG. 2 is a plan view of the overall layout of a polishing apparatus according to another embodiment of the present invention.

FIG. 2 shows a plan view of the overall layout of a polishing apparatus according to another embodiment of the present invention. As shown in FIG. 2, the polishing apparatus is provided with three loading/unloading stages 600 each for placing a cassette. A traveling mechanism 601 is provided along the loading/unloading units 600. A first transport robot 602 having two hands is provided on the traveling mechanism 601. Adjacent to the traveling mechanism 601 is disposed the below-described ITM 224. Hands of the first transport robot 602 are accessible to each of the cassettes on the loading/unloading units 600 and the ITM 224.

The polishing apparatus shown in FIG. 2 is provided with four polishing sections 604, 605, 606 and 607. These polishing sections 604, 605, 606, and 607 are disposed along the longitudinal direction of the apparatus. Each polishing section includes a polishing table 608 with a polishing surface, a top ring 609 for holding a substrate, such as a semiconductor wafer, and polishing a substrate by pressing it against the polishing table 608, a polishing liquid supply nozzle 610 for supplying a polishing liquid or a dressing liquid (e.g., water) onto the polishing table 608, a dresser 611 for carrying out dressing of the polishing table 608, and an atomizer 622 for spraying a mixed fluid of a liquid (e.g., pure water) and a gas (e.g., nitrogen) in the form of a mist from one or more than one nozzle to the polishing surface.

Adjacent to the polishing sections 604, 605 is disposed a first linear transporter 612 for transporting a substrate along the longitudinal direction. An turn over device 613 for turning over a substrate received from the first transport robot 602 is disposed above the first linear transporter 612 on the loading/unloading stage 600 side. Adjacent to the polishing sections 606, 607 is also disposed a second linear transporter 614 for transporting a substrate along the longitudinal direction.

The polishing apparatus includes a second transport robot 615, a turn over device 616 for turning over a substrate received from the second transport robot 615, four cleaning machines 617, 618, 619 and 620 for cleaning a polished substrate, and a transfer unit 621 for transferring a substrate between the inverter 616 and the cleaning machines 617, 618, 619 and 620. The second transport robot 615, the inverter 616 and the cleaning machines 617, 618, 619 and 620 are disposed in series along the longitudinal direction.

In the operation of such a polishing apparatus, a substrate in the cassette is carried in each of the polishing sections 604, 605, 606 and 607 via the turn over device 613, the first linear transporter 612, and the second linear transporter 614. A polished substrate is carried in each of the cleaning machines 617, 618, 619 and 620, via the second transport robot 615 and the turn over device 616, where the substrate is cleaned. The substrate after cleaning is returned to the cassette by the first transport robot 602.

Although four polishing tables are provided in this embodiment so that each set of two polishing tables carries out two-step polishing of a substrate, it is also possible to use four tables to carry out four-step polishing of a substrate.

Each of these polishing apparatuses is provided with an ITM (in-line thickness monitor) 224 as a measurement section for measuring a surface state, such as a thickness of a film to be polished, of a substrate before polishing or after post-polishing cleaning/drying. In particular, the ITM (measurement section) 224 is disposed at a location on a line extending from the traveling rails 200, as shown in FIG. 1, and measures a thickness of an insulating film such as an oxide film, or the polishing state of a conductive film such as a copper film or a barrier layer, in a surface of a substrate, such as a semiconductor wafer, using an optical means which emits light toward the substrate surface and receives an optical signal of the reflected light, before the transport robot 202 places the substrate after polishing into the cassette 204 or after the transport robot 202 takes the substrate before polishing out of the cassette 204.

Each of these polishing apparatuses is designed to be capable of detecting the removal of a conducive film from a substrate surface except a necessary region, such as an interconnect region, or the removal of an insulating film by monitoring sensor signals or measured values of such films during and/or after polishing of the substrate, determining polishing conditions for the respective steps of a multi-step polishing process and the endpoint of the polishing process, and repeating an appropriate polishing process. The ITM 224 is capable of measuring the surface state of a substrate over an entire surface (surface to be polished), so that the results of polishing at a particular portion of the substrate and the results of polishing over the entire substrate surface can be checked.

Figure 3:
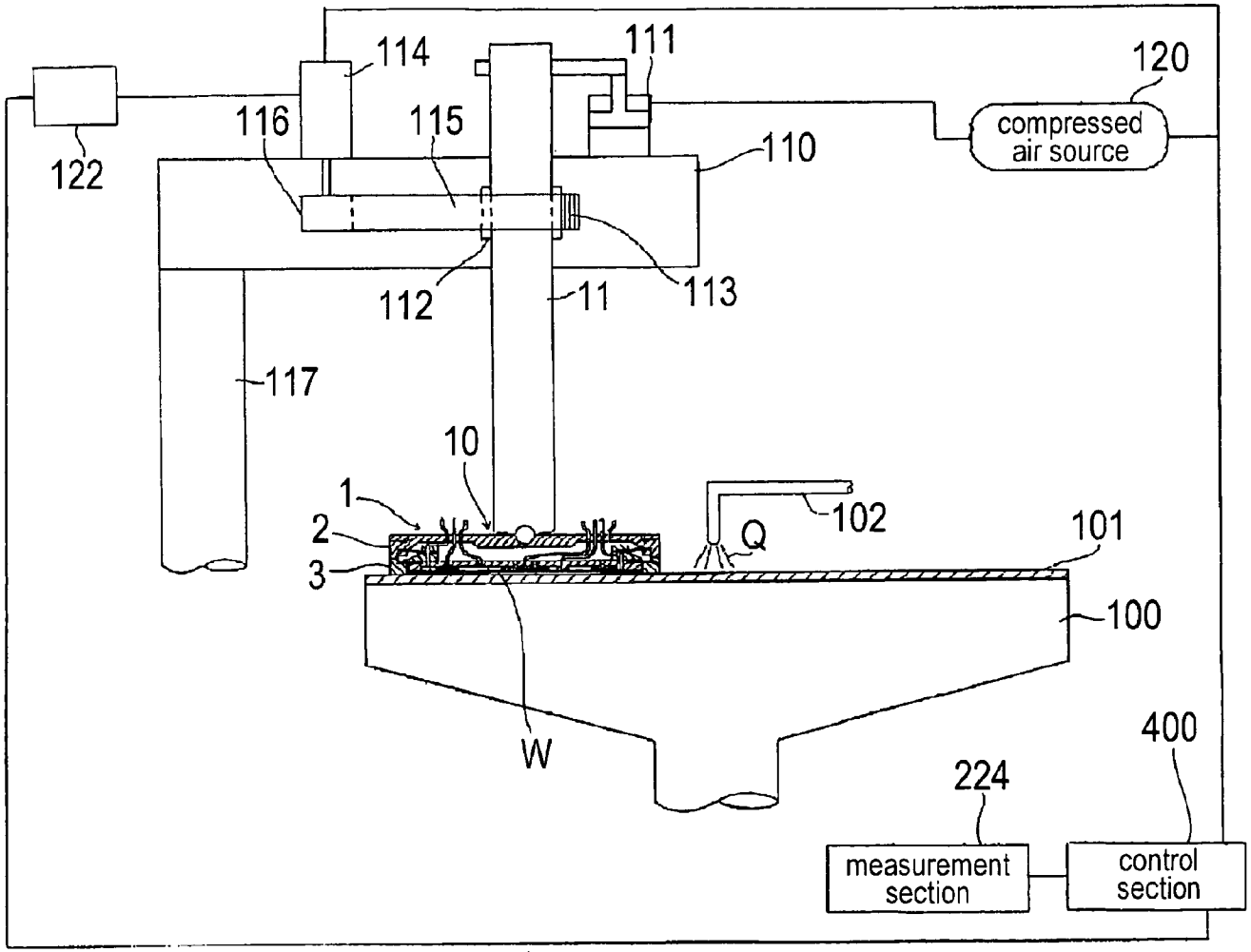
FIG. 3 is a schematic enlarged view of a polishing section of the polishing apparatus of FIG. 1.

The polishing section of the polishing apparatus holds a substrate such as a semiconductor wafer and a polishing object, and presses the substrate against a polishing surface on a polishing table, thereby polishing and flattening the surface of the substrate. FIG. 3 shows in detail a polishing section of the polishing apparatus shown in FIG. 1. As shown in FIG. 3, below the top ring 1 is disposed a polishing table 100 with a polishing pad (polishing cloth) 101 attached to the upper surface. Above the polishing table 100 is disposed a polishing liquid supply nozzle 102 which supplies a polishing liquid (slurry) Q onto the polishing pad 101 on the polishing table 100. The top ring 1 is movable also to a position right above the polishing table 216 with a polishing pad (polishing cloth) 217 attached to the upper surface. The polishing table 216 is designed to make a so-called scroll movement. In the interior of the polishing table 216 is provided a polishing liquid supply section (not shown) for supplying a polishing liquid onto the polishing pad 217. The polishing section is thus constructed.

According to the polishing apparatus shown in FIG. 1, a first polishing step of a substrate is carried out with the polishing table 100 and a second polishing step of the substrate is carried out with the polishing table 216 while the substrate is kept held by the top ring 1. A polishing liquid (slurry) Q, which has a high polishing rate for a film forming the uppermost layer of the substrate, such as an oxide film 306 (see FIG. 5), though low in its surface irregularities-eliminating property for film, is supplied to the polishing pad 101 of the polishing table 100. On the other hand, a polishing liquid (slurry) Q, which has a high surface irregularities-eliminating ability for the uppermost-layer film, such as the oxide film 306, though low in the polishing rate for the film, is supplied to the polishing pad 217 of the polishing table 216.

Various commercially-available polishing pads can be used as the polishing pads 101, 217. Examples include SUBA 800,IC-1000 and IC-1000/SUBA 400 (two-layer cloth), manufactured by Rodel, Inc., and Surfin xxx-5 and Surfin 000, manufactured by Fujimi Incorporated. SUBA 800, Surfin xxx-5 and Surfin 000 are non-woven fabrics each comprising fibers fixed with a polyurethane resin, and IC-1000 is a rigid foamed polyurethane (single layer). The foamed polyurethane is porous, and has numerous fine recesses or holes in the surface. The polishing pads 101, 217 basically are consumable members, and gradually wear out as they polish a surface of a substrate. In an actual polishing process, polishing pads 101, 217 are replaced with new ones when the polishing pads 101, 217 have come to a predetermined thickness or the polishing rates have become lower.

As shown in FIG. 1, the top ring 1 is connected via a universal joint 10 to a top ring drive shaft 11, and the top ring drive shaft 11 is coupled to a top ring air cylinder 111 secured to a top ring head 110. The top ring drive shaft 11 moves vertically by the top ring air cylinder 111, thereby moving the entire top ring 1 up and down and pressing a retainer ring 3, fixed to the lower end of a top ring body 2, against the polishing table 100 or 216. The top ring air cylinder 111 is connected to a compressed air source 120. The pressure of fluid, such as pressurized air, supplied to the top ring air cylinder 111 can be regulated, whereby the pressure of a substrate, held by the top ring 1, on the polishing pad 101 or 217 can be adjusted.

The top ring drive shaft 11 is coupled via a key (not shown) to a rotating cylinder 112 which is provided with a timing pulley 113 at its outer surface. A top ring motor 114 as a rotational. drive section, which is provided with a timing pulley 116, is secured to a top ring head 110. The timing pulley 113 is connected to the timing pulley 116 via a timing belt 115. Thus, by rotationally driving the top ring motor 114, the rotating cylinder 112 and the top ring drive shaft 11 rotate by the timing pulley 116, the timing belt 115 and the timing pulley 113, whereby the top ring 1 rotates. The top ring head 110 is supported by a top ring head shaft 117 secured to a frame (not shown).

The top ring motor 114 is provided with a torque measurement section 122 for measuring the torque of the motor 114. For example, when an insulating film on a substrate is removed and a metal film, formed under the insulating film, becomes exposed to a polishing surface during polishing of the substrate surface, the torque of the top ring motor 114 changes due to a change in the frictional force between the substrate surface and the polishing surface. The removal of the insulating film can be determined by detecting the change in the torque with the torque measurement section 122. Though the torque measurement section 122 measures the electric current of the top ring motor 114 in this embodiment, it may be one that actually measures the torque of the top ring motor 114. Though, in this embodiment, the torque measurement section 122 is provided in the top ring motor 114, it is also possible to provide a torque measurement section in a polishing table motor for rotating the polishing table 216.

Figure 4:
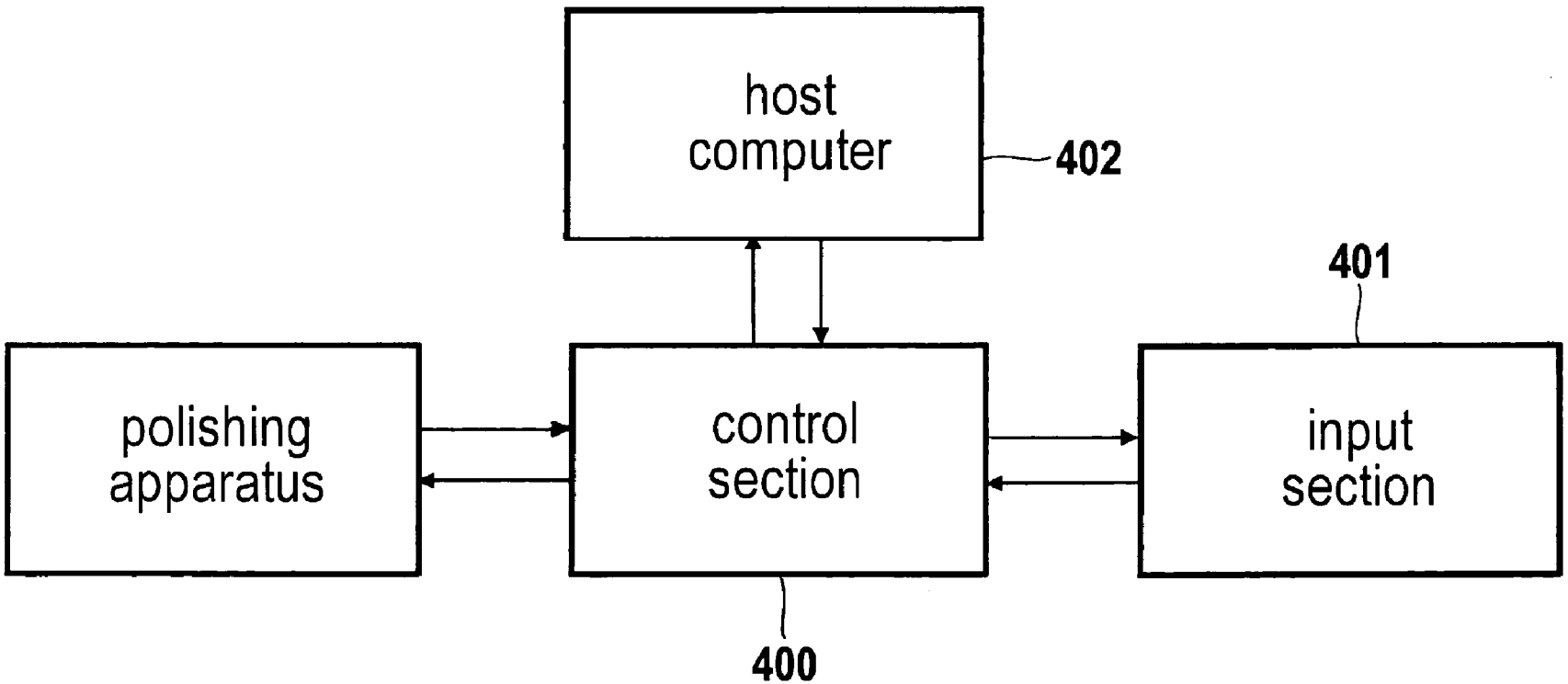
FIG. 4 is a control block diagram of the polishing apparatus of FIG. 1.

As shown in FIG. 3, signals from the ITM 224 and the torque measurement section 122 are inputted into a control section 400. As shown in FIG. 4, based on input from an input section 401, e.g., comprised of a man-machine interface, such as an operation panel, and input from a host computer 402 that performs various data processings, the control section 400 controls the polishing apparatus to polish a substrate W at a target polishing rate (polishing amount) so as to obtain a target profile, such as an intended surface configuration.

Figure 5A:
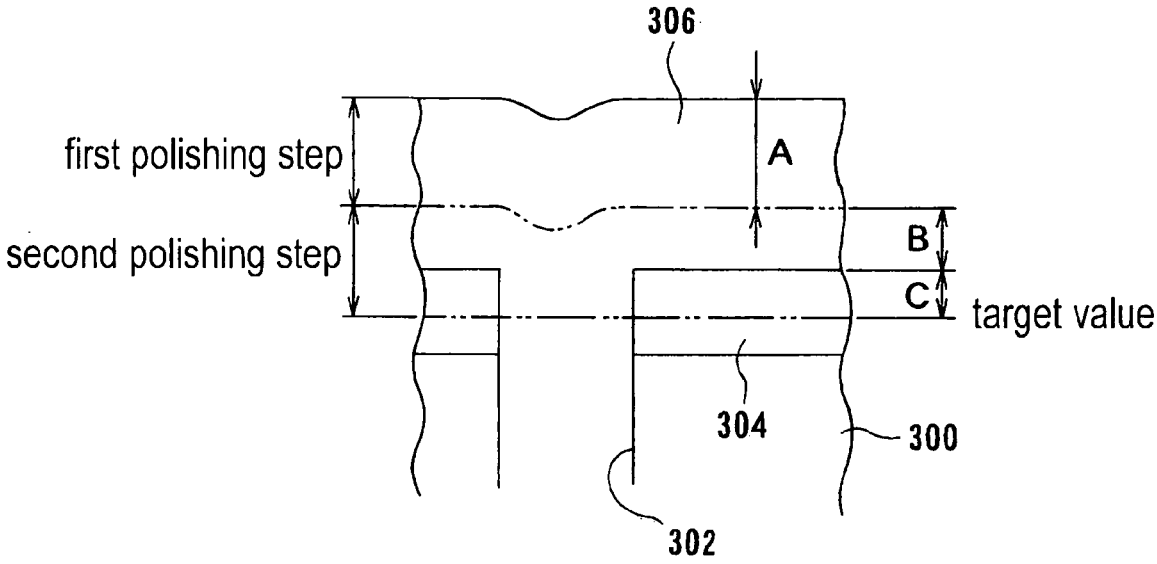
FIG. 5A is a diagram illustrating a two-step polishing process according to the present invention.
Figure 5B:
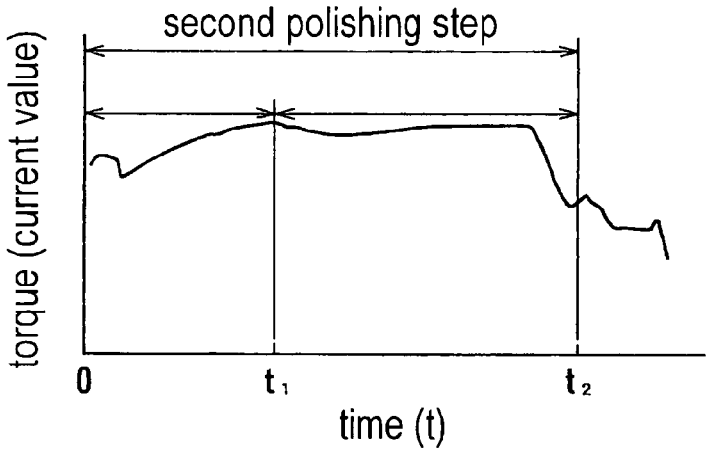
FIG. 5B is a graph showing the relationship between polishing time and the current value (torque) of a top ring motor in the second step of the two-step polishing process.
Figure 6A:
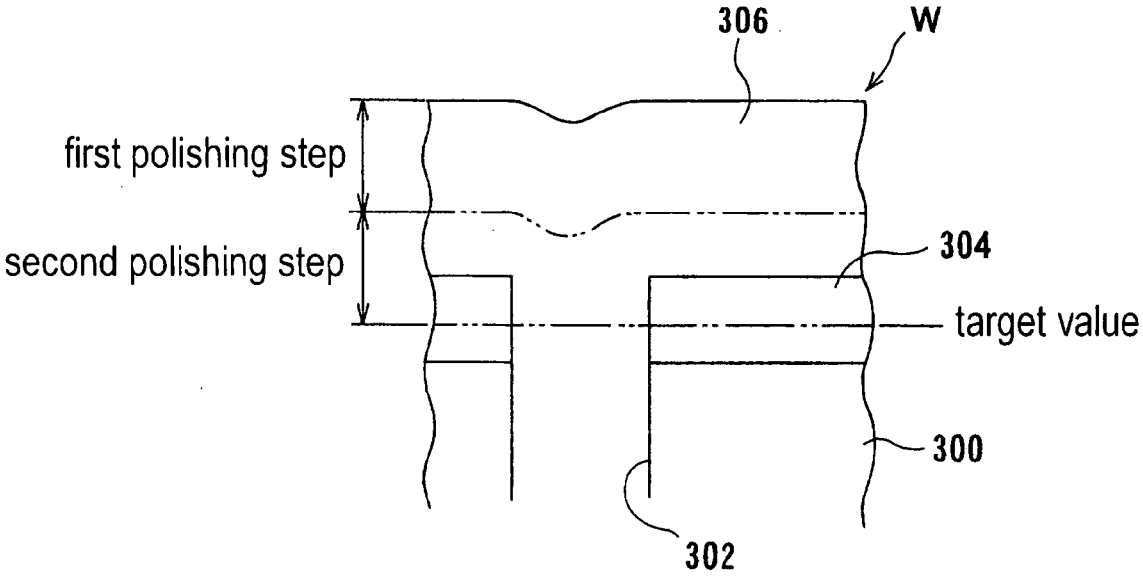
FIG. 6A is a diagram illustrating a conventional two-step polishing process.
Figure 6B:
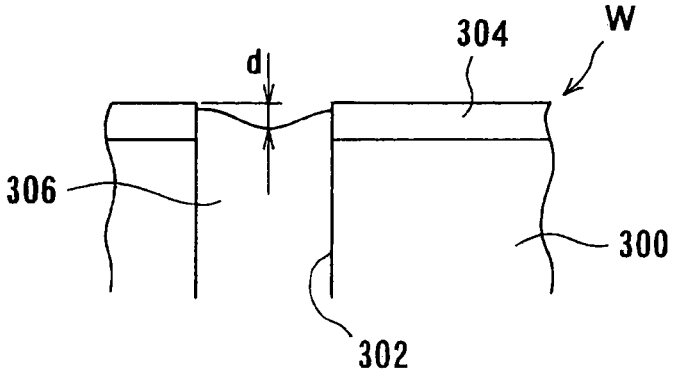
FIG. 6B is a diagram illustrating the surface state of a substrate as observed when the second step of the conventional two-step polishing process is carried out over a long time.

A description will now be made of a polishing method according to the present invention, executed by the control section 400 of the polishing apparatus. In this embodiment, a substrate W to be polished, as shown in FIG. 5A, is prepared by forming interconnect trenches 302 in an insulating layer 300 and forming a barrier film 304 of, e.g., SiN on a surface of the insulating layer 300, and then depositing an oxide film 306 on a surface of the barrier film 304 while filling the oxide film 306 into the trenches 302. A first polishing step of the substrate W is carried out to polish the oxide film 306 partway, and then a second polishing step is carried out to polish the remaining oxide film 306 and a predetermined amount (to a target value) of the barrier film 304, as shown in FIG. 5A.

According to the polishing apparatus shown in FIG. 1, substrates W housed in the cassette 204 are transported one by one by the transport robots 202, 208 to the rotary transporter 210 and held by the top ring 1. The substrate W held by the top ring 1 is subjected to a first polishing step with the polishing table 100, and then to a second polishing step with the polishing table 216. The substrate W after polishing is cleaned and dried by the cleaning machines 212, 214, and then retuned to the cassette 204.

In advance of the polishing process, the substrate W before polishing is transported by the transport robot 202 to the ITM 224 to measure the thickness of the oxide film 306 forming the uppermost layer of the substrate W. The thickness of the oxide film 306, which has been formed in the pre-polishing process, generally varies among substrates. In order to formulate a polishing recipe that compensates for the variation, the thickness of the oxide film (uppermost-layer film) 306, a polishing object, is measured before polishing. When a pre-polishing processing apparatus and the polishing apparatus can share information by a network or the like, information on a thickness of the uppermost-layer oxide film 306 of a substrate, if measured in the pre-polishing processing apparatus after the processing of the substrate, can be shared with the polishing apparatus. Thus, in this case, the pre-polishing measurement of a film thickness in the polishing apparatus is unnecessary.

The substrate W after the measurement of the thickness of the oxide film 306 is transported by the transport robot 208 to the rotary transporter 210, where the substrate W is held by the top ring 1. Using the polishing table 100, the first polishing step of the substrate W is carried out under preset polishing conditions. In particular, while rotating the polishing table 100 and the top ring 1, the substrate W held by the top ring 1 is pressed against the polishing pad 101 of the polishing table 100 at a predetermined pressure and, at the same time, a polishing liquid Q is supplied from the polishing liquid supply nozzle 102 to the polishing pad 101 of the polishing table 100. By carrying out the first polishing step using a polishing liquid (slurry) Q having a high polishing rate for the oxide film 306 but having a low surface irregularities-eliminating property for the oxide film 306, the polishing amount of the oxide film 306 is increased and the overall polishing time is shortened.

The first polishing step is terminated with the oxide film 306 slightly left on the barrier film 304 and not completely removed, as shown in FIG. 5A. The termination of the first polishing step is, for example, by time control. Thus, the first polishing step is terminated after carrying out the polishing for a predetermined time based on polishing time data in the polishing recipe.

Next, the substrate W after the first polishing step, which is kept held by the top ring 1, is moved to right above the polishing table 216. Using the polishing table 216, the second polishing step of the substrate W is carried out under preset polishing conditions. In particular, while rotating the polishing table 216 and the top ring 1, the substrate W held by the top ring 1 is pressed against the polishing pad 217 of the polishing table 216 at a predetermined pressure and, at the same time, a polishing liquid is supplied through the polishing liquid supply section formed in the polishing table 216 to the polishing pad 217 of the polishing table 216. In the second polishing step, the oxide film 306 on the barrier film 304 is completely polished, and the barrier film 304 is polished to a polishing target (in a predetermined amount), as shown in FIG. 5A.

By carrying out the second polishing step using a polishing liquid (slurry) having a lower polishing rate for the oxide film 306 than that of the first polishing step but having a higher surface irregularities-eliminating property for the oxide film 306 than that of the first polishing step, the oxide film 306 remaining on the barrier film 304 can be completely removed while flattening the surface of the oxide film 306. The termination of the second polishing step is, for example, by time control. Thus, a polishing time after the change of polishing object from the oxide film 306 to the barrier film 304 in the second polishing step is set in the polishing recipe, and the end point of polishing is determined based on the set time. The change of polishing object from the oxide film 306 to the barrier film 304 is detected by signals from the torque measurement section 122. In particular, when polishing in the second step shifts from the oxide film 306 having a thickness B to the barrier film 304 having a thickness C as shown in FIG. 5A, the current value (torque) of the top ring motor 114 gradually increases and, after complete removal of the oxide film 306, the current value (torque) of the top ring motor 114 gradually decreases. The time point "$t_1$" when the current value (torque) has reached the maximum is therefore regarded as the time of the change of polishing object from the oxide film 306 to the barrier film 304, and a time period from the time point $t_1$, "$t_1$-$t_2$", is set to control time at the end of polishing.

After the second polishing step, is the substrate W is transported transported by the transport robot 208 from the rotary transporter 210 to the cleaning machine 214 and then to the cleaning machine 212, where the substrate is cleaned and dried. Thereafter, the substrate W is transported by the transport robot 202 to the ITM 224 to measure the thickness of the barrier film 304 after polishing and the number of surface portions where dishing or erosion has occurred. The substrate W after the measurement is returned by the transport robot 202 to the cassette 204.

Data on the thickness of the oxide film (uppermost-layer film) 306 before polishing, the processing (polishing) time of the first polishing step, the processing (polishing) time ($t_1$) for the oxide film 306 in the second polishing step, the processing (polishing) time ($t_1$-$t_2$) for the barrier film (next-layer film) 304 in the second polishing step and the thickness of the barrier film 304 after the second polishing step, with respect to the substrate W, is stored in a database in the control section 400. Based on these data and on the ratio of the polishing rate for the oxide film 306 between the polishing liquid used in the first polishing step and the polishing liquid used in the second polishing step, the control section 400 calculates the polishing rates for the oxide film 306 in the first and second polishing steps.

After the calculation of the polishing rates, the next substrate W taken out of the cassette 204 is transported to the ITM 224 before polishing to measure the thickness of the oxide film 306. Based on the measured film thickness and on the above polishing rates calculated by the control section 400, a polishing time for the first polishing step is newly set. A first polishing step of the substrate W held by the top ring 1 with the polishing table 100 is carried out over the newly-set time and terminated. The polishing amount A of the oxide film 306 in the first polishing step is thus corrected, and the second polishing step can be started with the intended thickness of the oxide film 306.

The above-described setting of polishing conditions or formulation of polishing recipe makes it possible to ensure the intended thickness of a film forming the uppermost layer of a substrate W, such as the oxide film 306, at the start of the second polishing step without being influenced by the initial thickness of the uppermost-layer film. In addition, feedback of data on the last substrate makes it possible to formulate a polishing recipe taking account of a decrease in the polishing rate, e.g., due to deterioration of a consumable member used in the polishing process.

Furthermore, the two-step polishing process according to the present invention eliminates the need for film thickness measurement between the first and second polishing steps, thus increasing the throughput.

In this embodiment, the two sets of two tables 100, 216 are operated in parallel. In the parallel operation, the database or the control section 400 stores data on polishing or formulates a polishing recipe independently for each set of tables 100, 216. It is also possible to carry out the first and second polishing steps with one polishing table 100 by supplying two different types of polishing liquids Q to the polishing pad 101 of the polishing table 100. Also in this case, the database or the control section 400 stores data on polishing or formulates a polishing recipe independently for each of the two polishing tables 100 of FIG. 1. The same is true for each of the four polishing tables 608 of FIG. 2.

In this embodiment, the next substrate is in a standby state until the polishing rate of the oxide film 306 of the substrate W is calculated. On the other hand, in a so-called series operation in which the first polishing step and the second polishing step are carried out using different top rings and polishing tables, during shift from the first polishing step of a substrate using a first top ring and a first polishing table to the second polishing step using a second top ring and a second polishing table, the next substrate is transported to the first top ring. In such an operation, the polishing recipe for the next substrate is based on the polishing rate of the last-but-one substrate. Thus, during shift from the first polishing step of an nth substrate to the second polishing step, the next of (n+1)th substrate is subjected to the first polishing step. The polishing recipe for the (n+1)th substrate is based on the polishing rate of the (n−1)th substrate which has already finished polishing.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A polishing method for performing a plurality of polishing operations on a workpiece having a plurality of films to be polished, the method comprising:

measuring a thickness of an uppermost-layer film of a first workpiece;

after said measuring operation, performing a first polishing operation of polishing the uppermost-layer film for a first preset processing time;

after said measuring operation, performing a second polishing operation of polishing a remaining portion of the uppermost-layer film and a next-layer film until a second preset processing time elapses after detecting a change of polishing object from the uppermost-layer film to the next-layer film;

determining polishing rates of the uppermost-layer film in said first and second polishing operations based on the measured thickness of the uppermost-layer film and on a processing time taken to polish the uppermost-layer film in said first and second polishing operations; and measuring a thickness of a film forming an uppermost layer film of a predetermined subsequent workpiece, before polishing of the subsequent workpiece, and setting a new processing time for a first polishing operation of the subsequent workpiece.

2. The polishing method according to claim 1, wherein the subsequent workpiece is a next unpolished workpiece.

3. The polishing method according to claim 1, wherein the new processing time for the first polishing operation of the subsequent workpiece is set so that the uppermost-layer film of the subsequent workpiece has a predetermined thickness upon starting a second polishing operation of the subsequent workpiece.

4. The polishing method according to claim 1, wherein the first polishing operation is carried out by moving a polishing table and a top ring relative to each other, the polishing table having a polishing face, and the top ring holding the workpiece and pressing it against the polishing face, and wherein a change of polishing object from the uppermost-layer to the next-layer is detected by detecting the torque of a drive section for driving the polishing table or the top ring.

5. The polishing method according to claim 1, wherein the first polishing operation is carried out using a first polishing liquid, wherein the second polishing operation is carried out using a second polishing liquid, and wherein the first polishing liquid provides a higher polishing rate than the second polishing liquid, and the second polishing liquid provides a higher surface irregularities-eliminating property.

6. The polishing method according to claim 1, wherein the first polishing operation is carried out using a first polishing liquid, wherein the second polishing operation is carried out using a second polishing liquid, wherein the first polishing liquid provides a higher polishing rate than the second polishing liquid, and the second polishing liquid provides a higher surface irregularities-eliminating property, and wherein setting the new processing time includes setting the new processing time so as to optimize a total processing time of the subsequent workpiece and eliminate surface irregularities of the subsequent workpiece.

7. The polishing method according to claim 1, wherein the new processing time is set to equalize the uppermost-layer film at a start of the second polishing operation among a plurality of workpieces.

8. The polishing method according to claim 1, wherein the second processing time is set to yield a target thickness of the next-layer film.

9. A polishing apparatus comprising:

a polishing means for carrying out a first polishing operation of polishing an uppermost-layer film of a first workpiece for a first preset processing time and a second polishing operation of polishing a remaining portion of the uppermost-layer film and a next-layer film until a second preset processing time elapses after detecting a change of polishing object from the uppermost-layer film to the next-layer film;

a measurement means for measuring a thickness of the uppermost-layer film of the first workpiece before polishing; and a control means for determining polishing rates of the uppermost-layer film in the first and second polishing operations based on the thickness of the uppermost-layer film before polishing, measured with the measurement means, and on a processing time taken to polish the uppermost-layer film in the first and second polishing operations, and for setting a new processing time for a first polishing operation of a predetermined subsequent workpiece based on said polishing rates and on a thickness of a film forming an uppermost layer of the subsequent workpiece before polishing.

10. The polishing apparatus according to claim 9, wherein the new processing time for the first polishing operation of the subsequent workpiece is set so that the thickness of the uppermost-layer film becomes a predetermined thickness upon starting a second polishing operation of the subsequent workpiece.

11. The polishing apparatus according to claim 9, wherein the polishing section includes a polishing table having a polishing face and a top ring for holding the workpiece and pressing the workpiece against the polishing face, and wherein the change of polishing object from the uppermost-layer film to the next-layer film is detected by detecting the torque of a drive section for driving the polishing table or the top ring.

12. The polishing apparatus according to claim 9, wherein the polishing section has a first polishing table for carrying out the first polishing operation, and a second polishing table for carrying out the second polishing operation.

13. The polishing apparatus according to claim 9, wherein the polishing section has a polishing table for successively carrying out the first and second polishing operations.

14. A program for causing a computer to control a polishing apparatus, for performing a first polishing operation of polishing uppermost-layer film of a first workpiece for a preset processing time and a second polishing operation of polishing a remaining portion of the uppermost-layer film and a next-layer film until a preset processing time elapses after detecting a change of polishing object from the uppermost-layer film to the next-layer film determining polishing rates of a film forming the uppermost layer film of the first workpiece in said first polishing operation and said second polishing operation based on a thickness of the uppermost-layer film before polishing and on a polishing time taken to polish the uppermost-layer film in said first and second polishing operations; and setting a processing time for a first polishing operation of a subsequent workpiece based on said polishing rates and on a thickness of a film forming the uppermost layer film of the predetermined subsequent workpiece before polishing the subsequent workpiece.

15. The program according to claim 14, wherein the predetermined subsequent workpiece is the next unpolished workpiece.

16. The program according to claim 14, wherein the processing time for the first polishing operation of the subsequent workpiece is set so that the thickness of the uppermost-layer film of the subsequent workpiece becomes a predetermined thickness upon starting the second polishing operation of the subsequent workpiece.

* * * * *